US008713764B1

(12) United States Patent
Rittenhouse et al.

(10) Patent No.: US 8,713,764 B1
(45) Date of Patent: May 6, 2014

(54) CONNECTOR STRUCTURE

(76) Inventors: James Rittenhouse, Pembroke Pines, FL (US); Miguel Bevilacqua, Pembroke Pines, FL (US)

( * ) Notice: Subject to any disclaimer, the term of this patent is extended or adjusted under 35 U.S.C. 154(b) by 39 days.

(21) Appl. No.: 13/398,473

(22) Filed: Feb. 16, 2012

(51) Int. Cl.
*A44B 21/00* (2006.01)

(52) U.S. Cl.
USPC ..... 24/543; 24/3.11; 24/3.12; 24/600.4; 24/600.8

(58) Field of Classification Search
None
See application file for complete search history.

(56) References Cited

U.S. PATENT DOCUMENTS 4,673,070 A * 6/1987 Ambal ..... 190/108
7,007,352 B1 3/2006 Hill
7,080,430 B2 7/2006 Wemmer
7,251,867 B2 8/2007 Wemmer
2009/0117300 A1 5/2009 Thompson
2009/0277936 A1 11/2009 Rogers et al.
2009/0307878 A1 12/2009 Kadas
2011/0121043 A1 5/2011 Kincaid et al.
2011/0191933 A1 8/2011 Gregory et al.

* cited by examiner

*Primary Examiner* — Jack W. Lavinder
(74) *Attorney, Agent, or Firm* — Malloy & Malloy, P.L.

(57) ABSTRACT

A connector structured to removably attach an object to a support platform including an elongated, rigid material base having a locking assembly disposed thereon and including a retainer and a gripping member. The gripping member is movably connected to the retainer and disposable relative to the base into both a locking orientation and a release orientation, wherein the locking orientation comprises a predetermined portion of the gripping member disposed in gripping, at least partially penetrating relation to an exposed surface of a corresponding part of either the support platform or the supported object. An activating member is connected to the gripping member and movable therewith, wherein positioning force exerted on the activating member will selectively dispose the gripping member between the locking and release orientations.

19 Claims, 8 Drawing Sheets

CONNECTOR STRUCTURE

BACKGROUND OF THE INVENTION

1. Field of the Invention

This invention is directed to a connector specifically, but not exclusively, structured for use in combination with a MOLLE/PALS connecting or attaching system. The connector facilitates the removable attachment of a supported object, such as various types of military gear, to a support platform, typically comprising a support structure worn by an individual. The connector includes a base comprising at least one elongated base member of sufficient rigidity to easily pass through alternately disposed and aligned loops, characteristic of the MOLLE/PALS system, and mounted on the supported object and the support platform. A locking assembly is included on the connector and is easily manipulated to accomplish a secure attachment or quick detachment of the supported object from the support platform.

2. Description of the Related Art

The removable attachment and support of various types of military gear onto a load carrying structure worn by an individual is commonly referred to as a MOLLE/PALS attachment or connecting system. This method of attachment has become a de facto standard for modular tactical gear and has served to replace the "click and stick" system used in the earliest modular vest systems, of the type which may still be in use in many police departments. Currently there are three general modes of attachment in the MOLLE environment. They include the "Natick Snap" that uses a polyethylene reinforced webbing strap with the "Pushthedot" snap for security. In addition there is a polymer "Malace" clip as an alternative to the Natick snap concept. Finally, there are a variety of attachments that fall into "Weave and Tuck" categories in which the end of an interwoven strap is tucked into an items backing after attachment to a vest or pack.

The supported objects typically include modular packs, pouches, vests, holsters and other modern military gear which may be cooperatively structured with a support platform including backpacks, harnesses, etc. As such, the attachment or connecting system commonly used for the removable support of military gear, in the manner described above incorporates the "PALS" webbing structure. In cooperation therewith, the support platform will incorporate a "MOLLE" compatible system. The term "PALS" is an acronym for Pouch Attachment Ladder System and comprises a grid of webbing originated by the United States Army Development and Engineering Center and, as set forth above, is used to attach smaller equipment on to the load bearing platform mounted on an individual. Accordingly, the term "MOLLE" is an acronym for Modular Lightweight Load-Carrying Equipment.

More specifically, the MOLLE/PALS systems include both the supported object and the support platform having a plurality of elongated webbing strips. Each strip is attached to a corresponding surface in a manner which forms a plurality of successive, immediately adjacent loops along the length of the respective strips. Moreover, each of the strips on each of the supported object and support platform is substantially horizontally oriented and vertically spaced from one another. In order to provide a cooperative, reliable and easily attached and detached connecting system, the space between each of the plurality of webbing strips includes a predetermined transverse dimension. More specifically, the transverse dimension of the space located between each of the webbing strips of both the supported objects and the support platform are sufficient to allow a corresponding webbing strip on the other of the supported object or support platform to be positioned therein. As a result correspondingly disposed loops are disposed in linear or axial alignment with one another. This alignment of loops facilitates the passage of various types of connecters to pass there through in order to accomplish either an attachment or detachment of the supported object and support platform.

However, known or conventional connecting structures which have been adapted for use with the MOLLE/PALS system include recognized disadvantages. For example and as indicated above known connecting structures include flexible straps which are intended to pass through the successively aligned loops of both the supported object and the support platform. However, the flexibility of such straps inhibit their insertion through the aligned loops and as a result their use is time consuming and generally unreliable.

Accordingly, there is a need in this area for a connector having cooperative structuring to be efficiently and effectively used with the MOLLE/PALS systems in a manner which overcomes the commonly recognized disadvantages. As such, a proposed and improved connector should include sufficient rigidity to facilitate the threading of the connector through the aligned loops of the cooperative webbing strips of both the supported object and the support platform. Moreover, such a proposed and improved connector may also include a locking assembly having the ability to reliably maintain the connection between the supported object and the support platform. As such, a proposed locking assembly used in combination with a preferred and improved connector should be capable of easy and efficient positioning between a locking orientation and a release orientation. As such, an individual would be able to quickly facilitate the attachment or detachment of the supported object relative to the support platform.

SUMMARY OF THE INVENTION

The present invention is directed to a connector specifically, but not exclusively, structured for the removable attachment and support of various types of gear, incorporating a PALS webbing structure, to a support platform. The support platform may be of the type that is carried by an individual and incorporates a MOLLE compatible attachment system. As such, both the supported object and the support platform include a plurality of elongated webbing strips, wherein each strip is attached to a corresponding surface in a manner which forms a plurality of successive, immediately adjacent loops along the length of the respective strips. Moreover, each of the strips on each of the supported object and support platform are correspondingly oriented and include elongated spaces disposed there between which extend along the length thereof. As such, the space between each of the plurality of webbing strips has a transverse dimension which is sufficient to allow a cooperative webbing strip to be positioned therein. As a result, correspondingly disposed loops are axially aligned. In turn, this alignment of the loops facilitates the passage of the connector of the present invention to be "threaded" or to pass there through, in order to maintain a supported attachment of the supported object on the support platform.

Therefore, the connector of the present invention includes a base comprising at least one elongated base member formed of a rigid material. The rigidity of the one base member may be such as to allow at least a minimal flexing thereof, but is sufficient to facilitate passage of the one base member through the aligned, alternating loops of both the supported object and the support platform. Therefore, such a "threading" of the connector through the aligned loops facilitates a quick and easy, supporting attachment of the supported object to the support platform. Moreover, the removal of the at least one base member of the connector from the aligned loops is quickly and easily accomplished thereby facilitating an equally easy and efficient detachment of the supported object from the support platform.

In addition, the connector includes a locking assembly disposed on the at least one base member, preferably at one end thereof and including a retainer and a gripping member. The gripping member is pivotally or otherwise appropriately movable on the retainer and is selectively disposable relative to both the base and the retainer into either a locking orientation or a release orientation. Stability and reliability of the connector is assured by the locking orientation of the gripping member comprising a predetermined portion thereof disposed in gripping, at least partially penetrating engagement with an outer surface of a next adjacent, correspondingly disposed webbing strip. As set forth hereinafter in greater detail, the webbing strip engaged by the gripping member may typically be mounted on the support platform. However as will be apparent, the webbing strip gripped by the gripping member may be mounted on either the support platform or the supported object.

Other structural and operative features of at least one preferred embodiment of the connector includes the gripping member and the retainer having cooperative structuring to facilitate the selective and alternate positioning and maintenance of the gripping member into either the locking orientation or the release orientation. Selective positioning of the gripping member is of course dependent on the intent of an individual to maintain the attachment or affect a detachment of the supported object on the support platform. Further, such cooperative structuring between the retainer and the gripping member may be at least partially defined by a movable frictional and/or snap-action engagement of correspondingly disposed and interactive parts thereof.

In order to facilitate a secure attachment of the supported object to the support platform, the retainer is preferably disposed, dimensioned and configured in an outwardly spaced relation to a corresponding part of the base of the connector. As such, when operatively disposed, the retainer may be disposed in overlying at least partially covering relation to a next adjacent or correspondingly positioned loop of the webbing strip which it engages. This disposition of the retainer of the locking assembly facilitates the aforementioned movement of the gripping member into and out of the locking orientation. As a result an effective gripping engagement is accomplished with an outer portion or surface of the next adjacent, correspondingly disposed webbing strip.

Additional features of the locking assembly may also include an activating member disposed and structured to position the gripping member between the aforementioned gripping and release orientations. The activating member is connected to the gripping member in an outwardly extending or otherwise readily accessible location relative to the base and a remainder of the locking assembly. Moreover, the activating member may be integrally or fixedly secured to the gripping member such as, but not limited to, defining an outer end thereof. Accordingly, the exertion of a positioning force on the activating member will cause the gripping member to move between the locking and release orientations, again dependent on whether the supported object and support platform are to be attached or detached from one another. As explained in greater detail hereinafter, the disposition and structuring of the activating member thereby facilitates a quick, easy, and efficient positioning of the gripping member into the release orientation when it is desired to quickly remove the supported object from the support platform.

Additional structure which may be associated with the activating member is a pull member, such as a cord secured to the activating member. As such, the pull cord facilitates greater accessibility to the activating member at least in terms of exerting the aforementioned positioning force thereon. The ability to quickly release the supported object from the support platform is thereby further enhanced.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
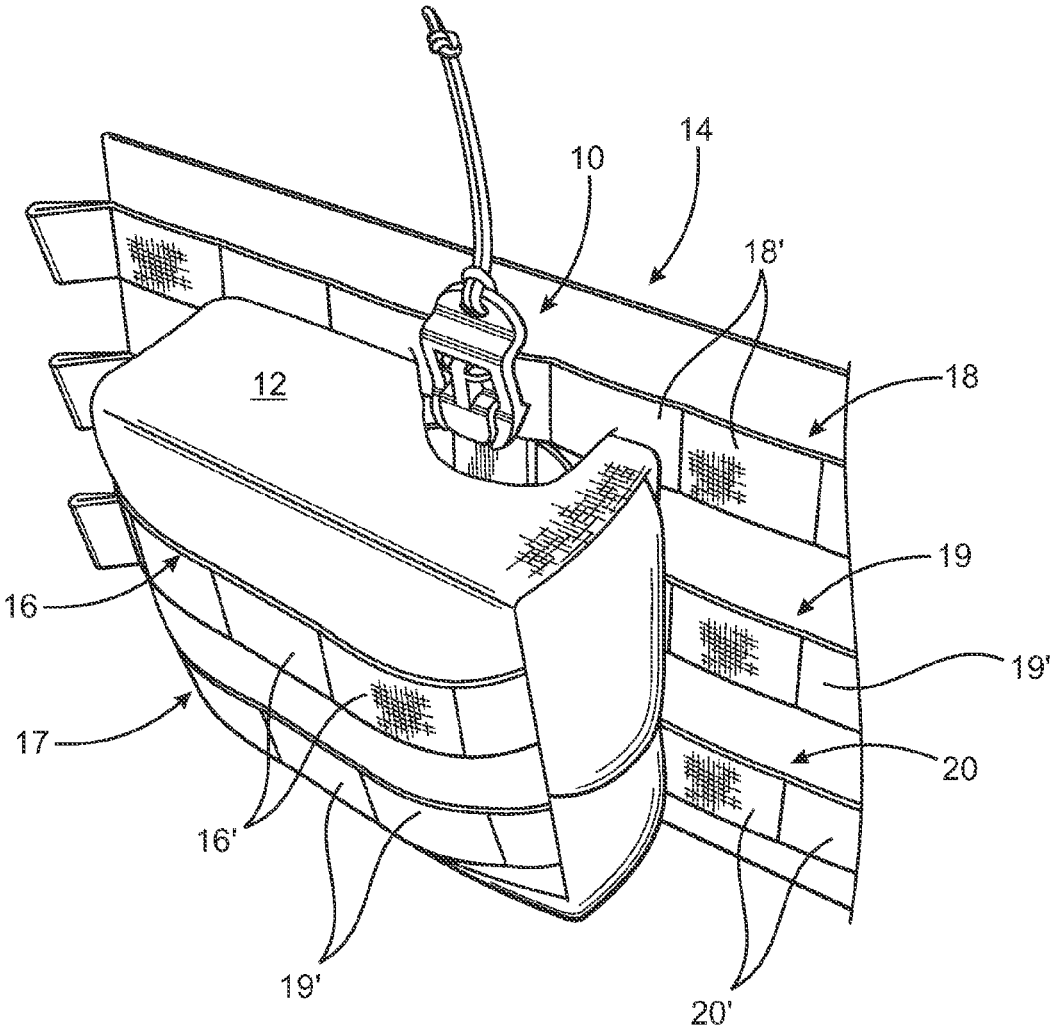
FIG. 1 is a perspective view in partial cut away of a connector of the present invention disposed in interconnecting relation between a support platform and a supported object, which incorporate the MOLLE/PALS connecting system.
Figures 2A, 2B, 2C:
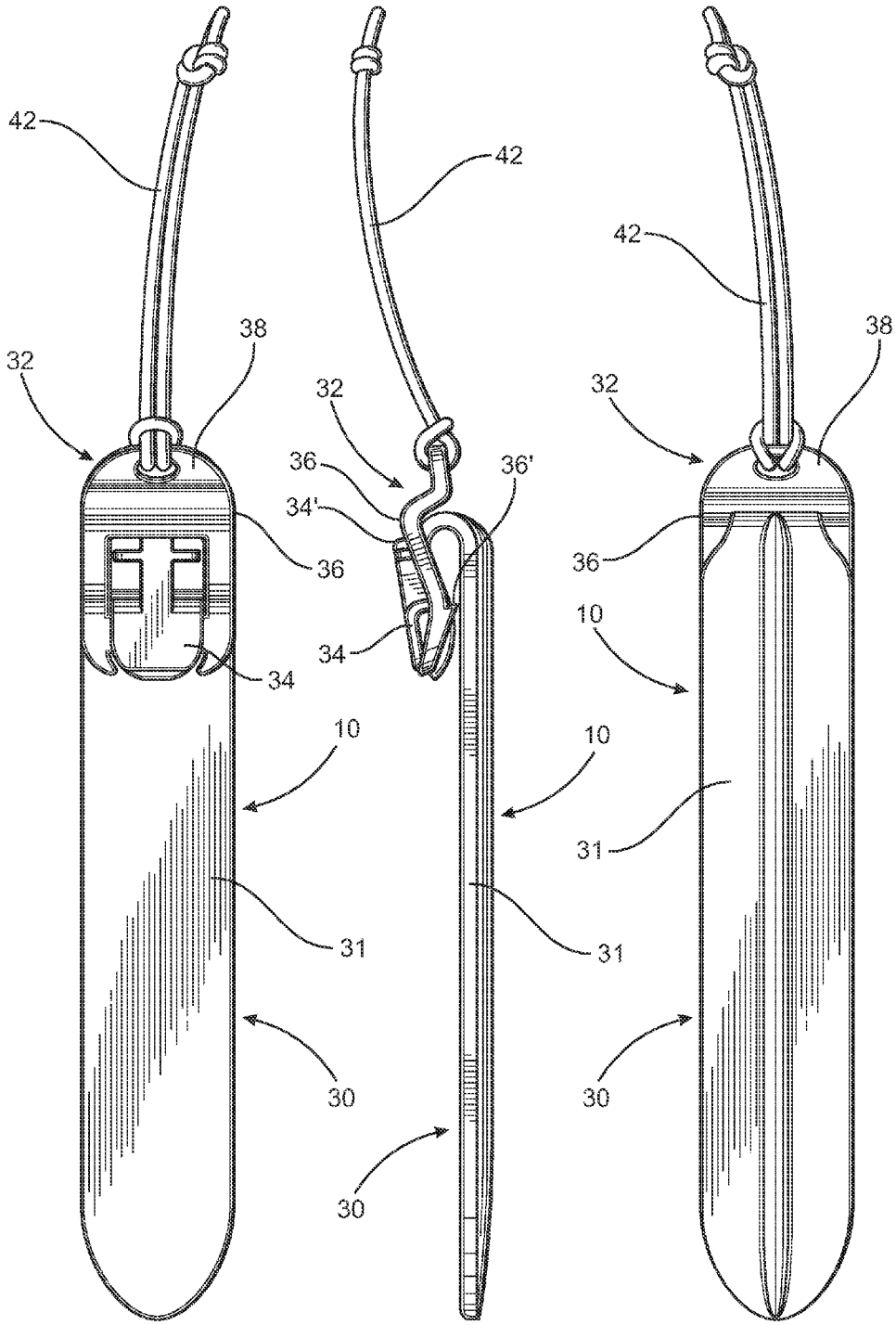
FIG. 2A is a front view of the connector of the embodiment of FIG. 1.
FIG. 2B is a side view of the connector of the embodiment of FIGS. 1 and 2A.
FIG. 2C is a rear view of the embodiment of FIGS. 1, 2A and 2B.
Figure 3:
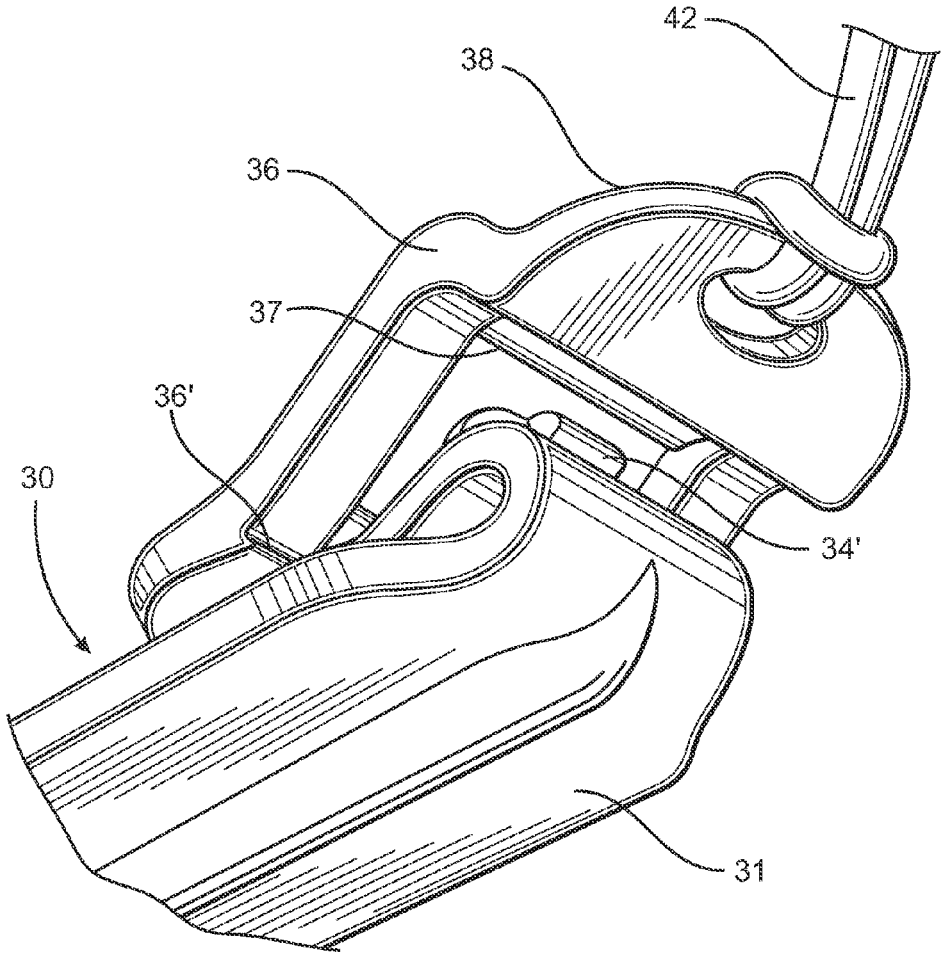
FIG. 3 is a perspective rear view in partial cutaway of a locking assembly associated with the connector of the embodiment of FIG. 1.
Figure 4:
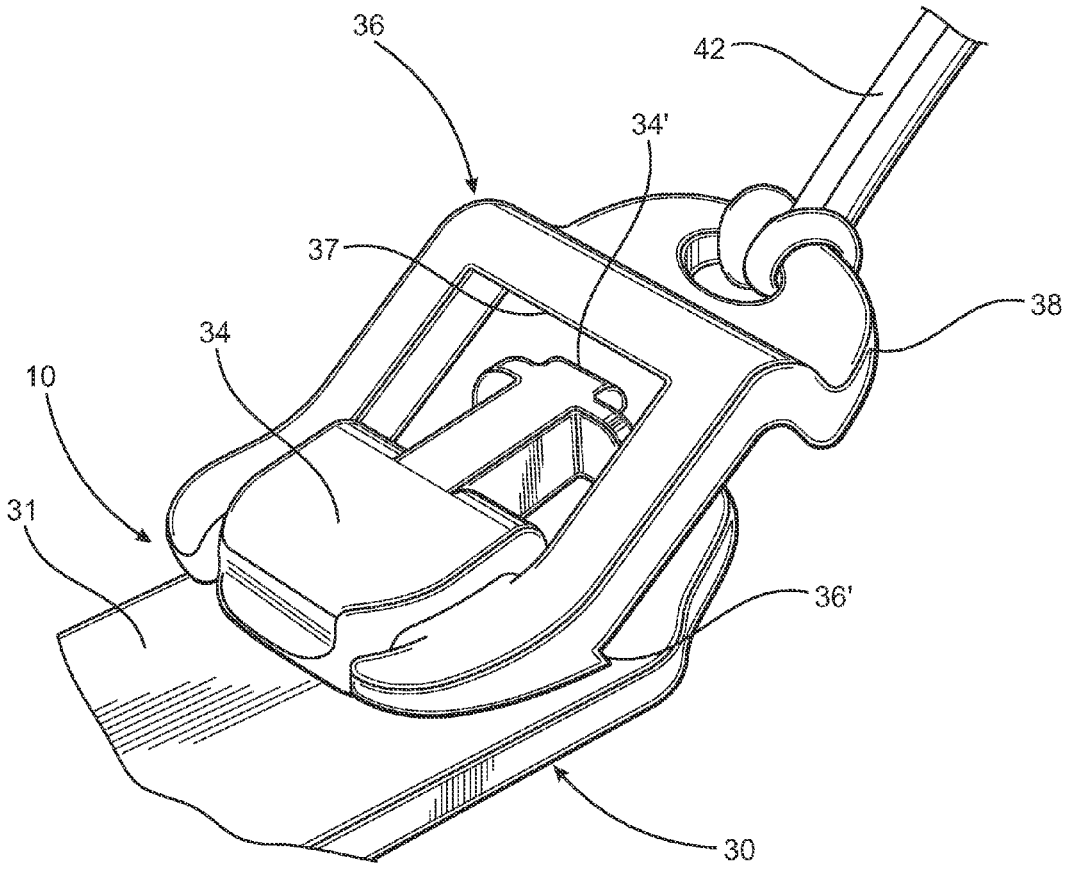
FIG. 4 is a front perspective view in partial cutaway of the locking assembly of the embodiment of FIG. 3.

As shown in the accompanying drawings, the present invention is directed to a connector, generally indicated as 10. As represented the connector 10 is structured to removably and reliably connect a supported object 12 to a support platform 14. As clearly evident in FIG. 1, the connector 10 is specifically, but not exclusively, for use in combination with a MOLLE/PALS attachment or connecting system. As is well recognized the MOLLE/PALS system, as well as attaching or connecting systems compatible therewith, are extensively used for removably securing military gear of various types to a vest, support belt or other garment type structure intended to be worn by or mounted on an individual. For purposes of clarity, the individual as well as the complete structural details of the supporting garment or like structure are not shown.

Therefore, as is also well known the PALS webbing structure as well as the MOLLE attachment system are cooperatively structured to include a plurality of webbing strips. More specifically and as clearly represented in FIG. 8, the webbing strips on the military gear or supported object 12 are respectively indicated as 16 and 17. The MOLLE system, associated with the support platform 14, also includes a plurality of elongated strips 18, 19, 20 etc. It is emphasized and commonly recognized that the MOLLE/PALS system includes each of the plurality of webbing strips 16 and 17 being attached to the surface of the supported object 12 in a manner which forms a plurality of immediately adjacent loops 16', 17'.

Figure 8:
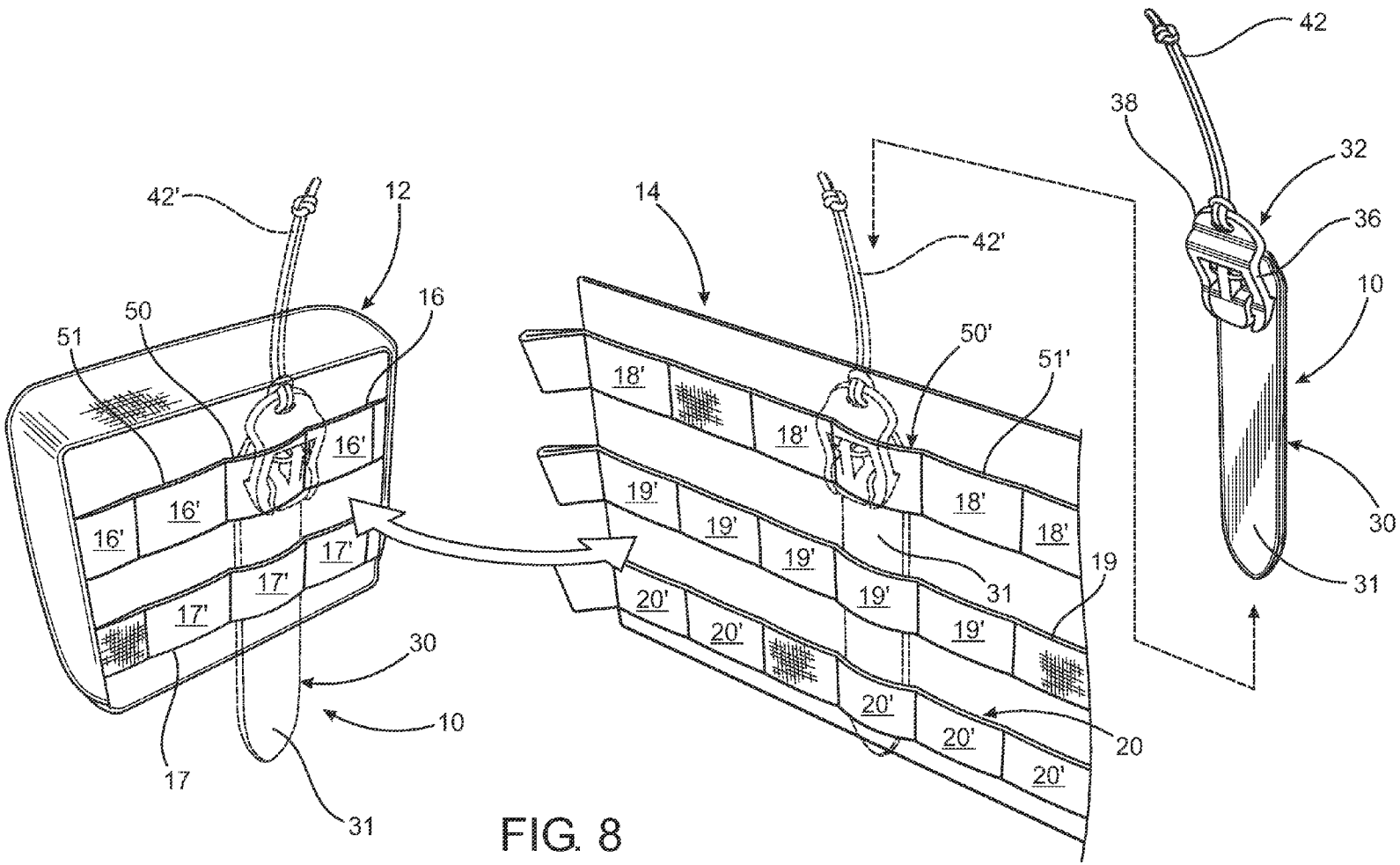
FIG. 8 is a perspective, exploded view in partial phantom and cutaway representing the different operative positions of the connector of the embodiment of FIGS. 1 through 7 relative to the supported object and the support platform.

Similarly and as also represented in FIG. 8, the webbing strips 18 through 20 of the support platform 14 are attached to the corresponding surface in a manner which forms a plurality of immediately adjacent loops 18', 19' and 20'. In addition each of the webbing strips 16 and 17 on the supported object 12 are disposed in spaced relation to one another by elongated spaces 22. Cooperatively, each of a plurality of elongated spaces 24 is disposed between the adjacently disposed webbing strips 18 through 20. Moreover, the transverse dimension of each of the respective elongated spaces 22 and 24 are sufficient to respectively receive a correspondingly disposed webbing strip of the support platform 14 and the supported object 12 therein.

Figure 5:
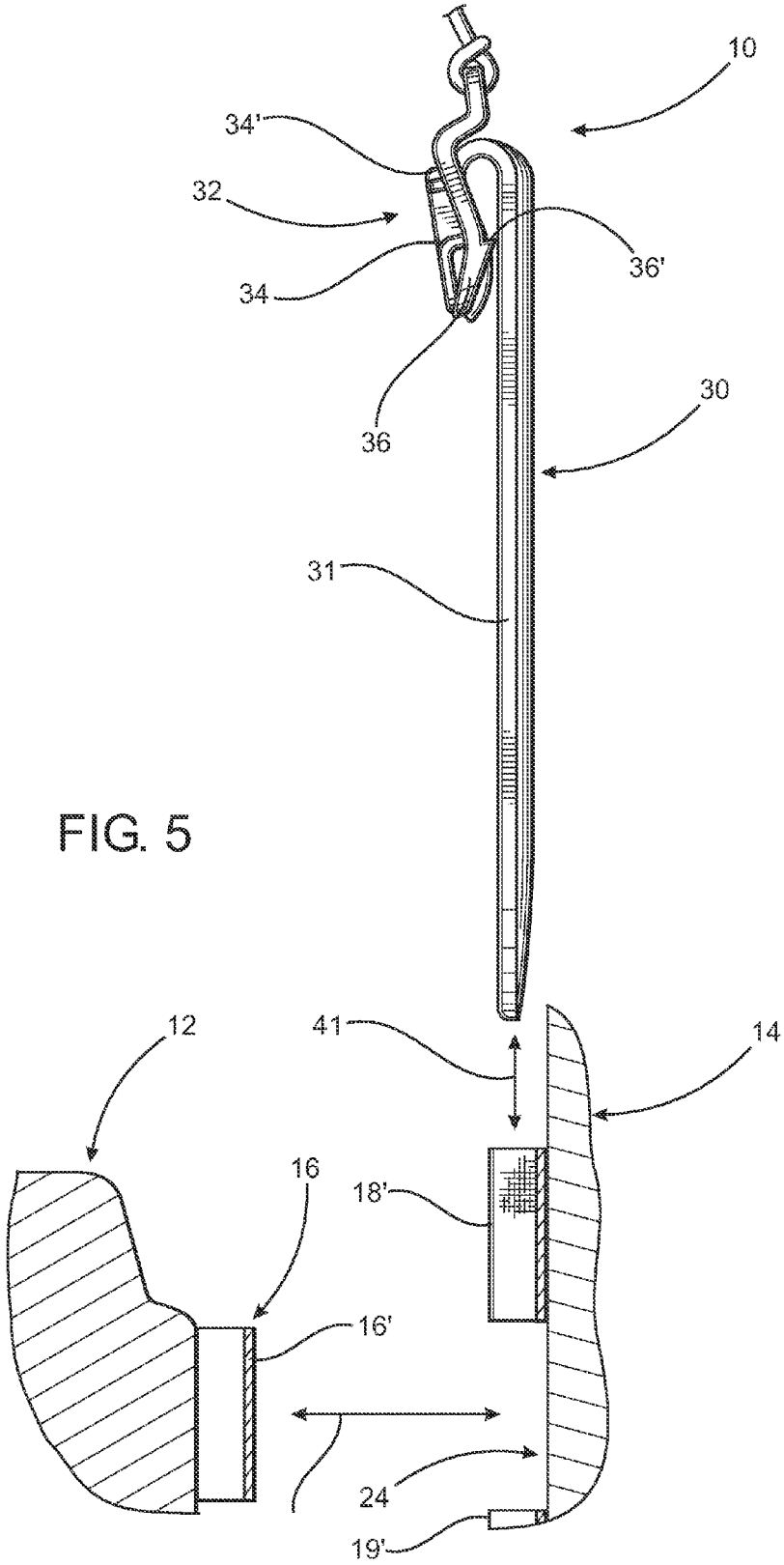
FIG. 5 is an exploded view representing the operative positioning which accomplishes attachment or removal of the connector relative to both the supported object and support platform.
Figure 7:
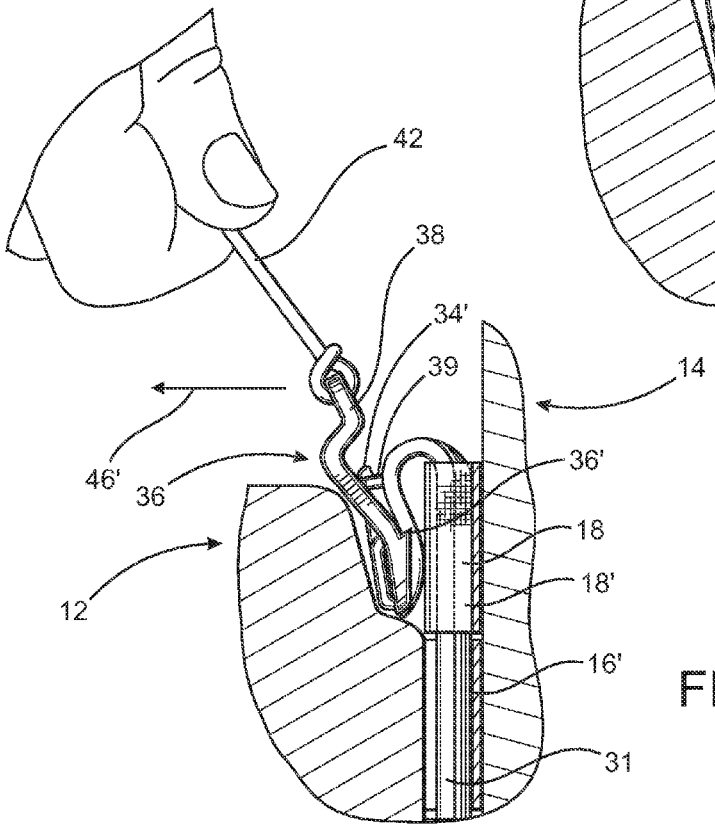
FIG. 7 is a sectional view in partial cutaway of the connector of the embodiment of FIG. 6 in an operative position and the locking assembly in a release orientation.

More specifically, as represented in FIGS. 5 and 7 operative positioning of the supported object 12 on the support platform 14 into the operative position represented in FIG. 1 calls for the webbing strips 16 and 17 of the supported object 12 being disposed within the elongated spaces 24 of the support platform 14. Concurrently corresponding ones of the webbing strips 19 and 20 of the support platform 14 will be disposed within the corresponding spaces 22 of the supported object 12. In addition, the operative positioning of the supported object 12 on the support platform 14, as represented in FIG. 1, will also be defined by an axial alignment of the corresponding and immediately adjacent loops 18', 16', 19', 17', 20' as also at least partially demonstrated in FIGS. 5 and 7. This axial or linear alignment of correspondingly positioned loops will allow and facilitate the passage or "threading" of the connector 10 through the aligned an immediately adjacent loops 18', 16', 19', 17,', 20' etc. and thereby serve to maintain a supported interconnection of the supported object 12 on the support platform 14.

Figure 6:
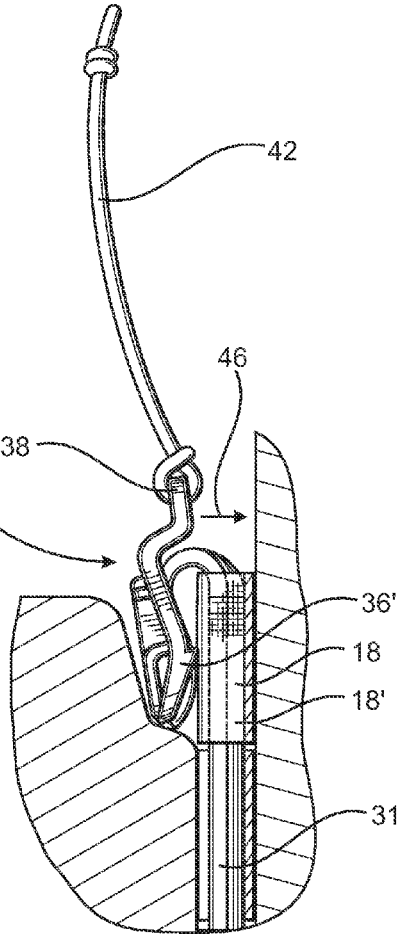
FIG. 6 is a sectional view in partial cutaway of the connector represented in an operative position and the locking assembly disposed in a locking orientation.

As represented in FIGS. 1-8 the structural and operative features associated with the connector 10 include a base 30 comprising at least one elongated base member 31 formed from a rigid material and preferably, but not necessarily, being of a one piece construction. The length of the one base member 31 should be sufficient to pass or be threaded through immediately adjacent and axially aligned ones of the plurality of loops 18', 16', 19', 17', 20', etc., as schematically represented by arrow 41 in FIG. 5. However, a shorter length of the base 30 may be operable to establish the operative interconnection and attachment of the supported object 12 to the support platform 14 as represented in FIGS. 1, 6 and 7. While the degree of rigidity of the one base member 31 may vary and demonstrate at least a minimal amount of flexibility, it should be sufficiently rigid to facilitate the threading or passage thereof through the aligned loops of the adjacently positioned webs 16, 17 of the supported object 12 as well as the loops of webbing strips 18 through 20 of the support platform 14.

In addition, the connector 10 includes a locking assembly generally indicated as 32 disposed preferably, but not necessarily, at one end of the base 30. The locking assembly 32 includes a retainer generally indicated as 34 and a gripping member generally indicated as 36. In at least one embodiment, the gripping member 36 is pivotally or otherwise appropriately movable relative to the retainer 34 and the base 30. As such, the locking assembly 32, and more specifically the gripping member 36, is selectively positioned between a locking orientation, such as represented in FIG. 6, and a release orientation such as represented in FIG. 7. Moreover, when in the locking orientation at least a portion of the gripping member 36 is disposed in gripping engagement with the correspondingly disposed webbing strip 18 in FIG. 6.

In more specific terms, the gripping member 36 includes at least one portion or segment such as projection 36' which extends outwardly from the rear or corresponding surface of the gripping member 36. As such, the projection 36' is disposed in gripping engagement and/or at least minimally penetrating relation to the outer surface or face of the next adjacent and correspondingly disposed webbing strip 18 and loop 18'. Moreover, as represented in FIG. 7 as the locking assembly 32 and more specifically the gripping member 36 is disposed in the release orientation, as represented in FIG. 7, the gripping projection 36' or other appropriate part of the gripping member 36 is disposed out of gripping engagement with the outer surface or face of the correspondingly disposed webbing strip 18 or loop 18'. Therefore, when the locking assembly 32 and/or gripping member 36 is in the release orientation of FIG. 7 the connector 10 can be easily removed from its threaded, interconnecting relation with immediately adjacent, aligned, alternating loops, 18', 16', 19', 17', 20', etc. as indicated by directional arrow 41 in FIG. 5. As should be apparent, when the connector is removed from its interconnecting relation with corresponding loops, the supported object 12 can be into or out of a confronting relation with the support platform 14, as schematically indicated by directional arrow 41' in FIG. 5.

The gripping member 36 may be selectively disposed in either the locking orientation of FIG. 6 or the release orientation of FIG. 7, by exerting a positioning force on the gripping member 36. In order to further facilitate the exertion of the required positioning force on the gripping member 36, another structural feature thereof includes an activating member 38 connected to the gripping member 36. In at least one embodiment of the present invention, the activating member 38 is fixedly or integrally connected to the remainder of the gripping member 36 and may be disposed in an outwardly extending, readily accessible position as represented. Therefore, directional arrow 46 in FIG. 6 schematically represents a positioning force being exerted on the gripping member 36 via the activating member 38 which serves to dispose the gripping member 36 into a locking orientation. In contrast, FIG. 7 represents the directional arrow 46' being exerted on the gripping member 36 via the activating member 38 so as to dispose the gripping member 36 into the release orientation and out of the locking orientation of FIG. 6.

In order to facilitate the exertion of the positioning force 46, 46' on the gripping member 36 a pull member, such as a pull cord 42 may be attached to the activating member 38. As a result, the exertion of the positioning force 46 and/or 46' on the gripping member 36 is significantly facilitated by actively accessing the gripping member 36 in order to position it by gripping and/or manipulating the pull member or pull cord 42. As should be apparent the pull member 42 may be in the form of a flexible cord or any other appropriate structure which facilitates its gripping, pulling or other manipulation.

In addition, the retainer 34 and the gripping member 36 are cooperatively disposed, dimensioned and structured to removably maintain the gripping member 36 in either the locking orientation of FIG. 6 or the release orientation of FIG. 7. Such cooperative structuring serves to maintain the gripping member in either of the locking orientation or release orientation, until the appropriate positioning force 46 or 46' is applied to the gripping member 36. More specifically, with primary reference to FIGS. 3 and 4, retainer 34 includes at least one part or portion thereof 34' which is disposed in interruptive relation to a gripping part or portion 37 of the gripping member 36. Therefore, as the gripping member 36 moves relative to the retainer 34 and the one base member 31, between the locking orientation and the release orientation, gripping part 37 of the gripping member 36 moves past and in frictional but movable engagement with the part 34' of the retainer 34.

More specifically, as the gripping member 36 moves between the locking or releasing orientations, the gripping part 37 thereof will come into abutting but movable and frictional sliding engagement with the part or portion 34' of the retainer 34. However, the dimensional tolerances between the gripping part 37 and the retainer part 34' are such as to allow movement of the gripping part 37 beyond the retainer part 34' and into and out of the locking or release orientations, when sufficient positioning force 46 and 46' is exerted on the gripping member 36. Therefore, the movable, frictional engagement between the gripping part 37 and the retainer part 34' can be said to at least provide a frictional, "snap-action" movement between the gripping member 36 and the retainer 34 as the positioning forces 46 and 46' are alternatively exerted on the gripping member 36.

Further, the configurations of the retainer part 34' and the gripping part 37 as well as there cooperative dimensional tolerances are such as to removably maintain the gripping member 36 into either of the locking and/or release orientations once disposed therein. With further reference to FIGS. 6 and 7 the disposition and configuration and overall structure of the retainer 34, specifically, but not exclusively, including the retainer part 34' is such as to create a recess or channel 39, as represented in FIG. 7. Accordingly, the recess or channel 39 is disposed and configured to removably receive the gripping part 37, when the gripping member 36 is in the gripping orientation of FIG. 6. As a result, a sufficient positioning force 46' must be exerted on the gripping member 36 to remove the gripping part 37 from the recess or channel 39 and beyond the retainer part 34' as a movable, frictional, snap-action engagement occurs between the retainer part 34' and the gripping part 37. Therefore, the gripping member 36 will be at least partially maintained in the release orientation of FIG. 7 until a sufficient positioning force 46 is exerted thereon in order to overcome the frictional, sliding, snap-action between the gripping part 37 and the retainer part 34'.

As represented in FIG. 8, the connector 10 may be disposed such that the webbing strip engaged by the gripping member 36 may be either the webbing strip 16 and the loop 16' or the webbing strip 18 and loop 18'. Typically the connector 10 will be mounted on the support platform 14, such that the gripping member 36 will engage and possibly at least minimally penetrate the outer surface or face of a next adjacent and corresponding loop 18'. However, as also represented in FIG. 8, the connector may also be operatively disposed to grip and engage the outer surface or face of the webbing strip 16 and corresponding loop 16'. Therefore, it should be apparent that the connector 10 may be disposed such that the gripping member 36 may engage either the support platform 14 or the supported object 12 to accomplish a supported attachment there between. Accordingly, the positioning of the connector 10 in either of the phantom positions of FIG. 8, indicates that the gripping member 36 will grip and possibly minimally penetrate the outer surface of the next closest, next adjacent, corresponding and/or upper most webbing strip and loop, 16 and 16' or 18 and 18'.

Figure 9:
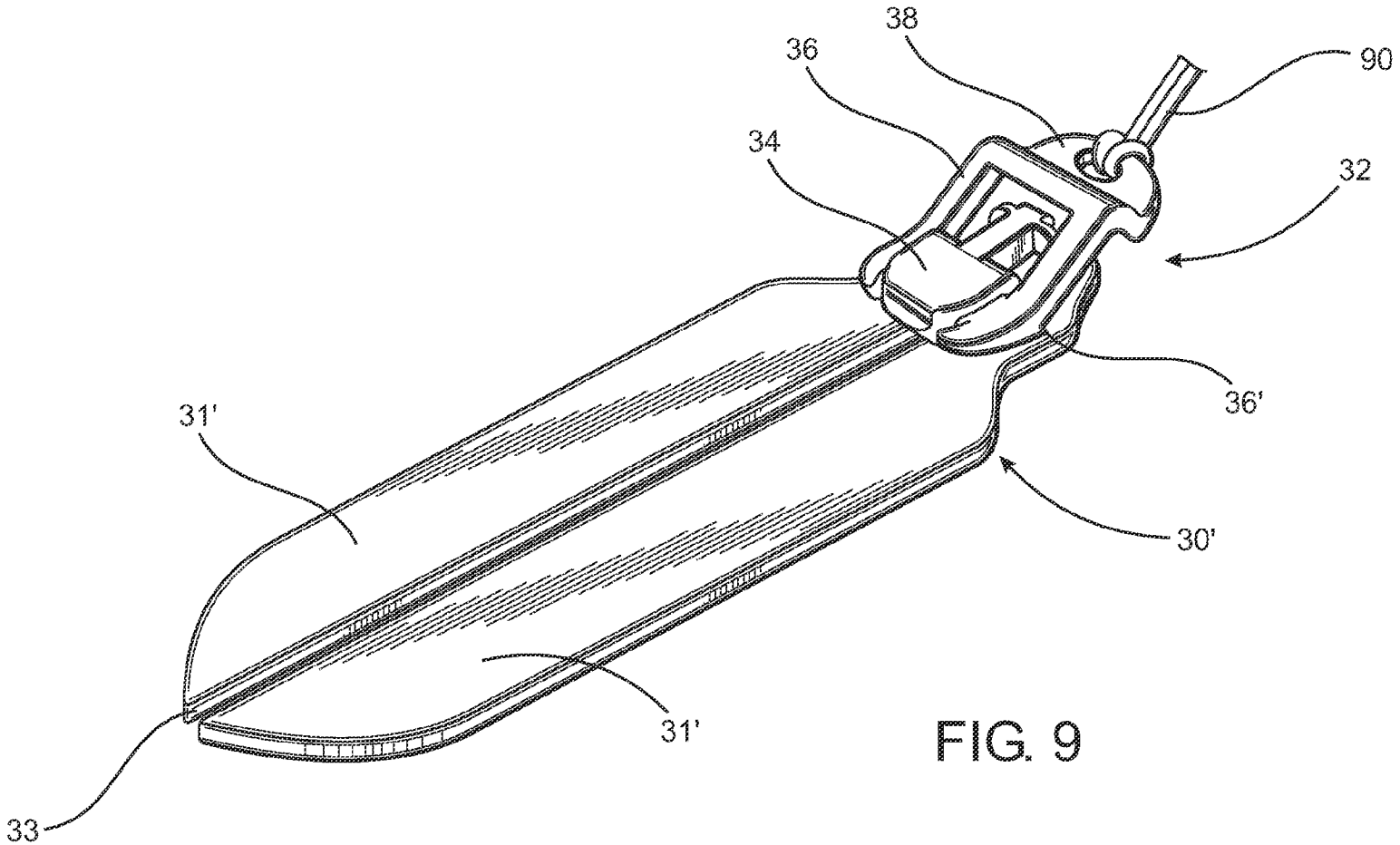
FIG. 9 is a perspective view of another preferred embodiment of the present invention wherein a base of the connector includes a plurality of base members.

With primary reference to FIG. 9, another embodiment of the present invention comprises a connector 10' having a base 30' comprising a plurality of at least two base members 31'. As with the embodiments Of FIG. 1-8, the base members 31' include an elongated configuration and are formed of a sufficiently rigid material to facilitate the "threading" thereof through correspondingly aligned loops of the supported object 12 and support platform 14. In addition an elongated space 33 is disposed between inner portions of the base members 31' and extends along a majority or substantially the entire lengths thereof, as indicated. As also represented, the base members 31 may also be disposed in side-by-side, substantially coplanar relation to one another.

Accordingly, the relative positions and structuring of the base members 31', as well as the provision of the space 33 there between, facilitates there concurrent threading or passage through adjacent columns of loops 50, 51 of the supported object and columns of loops 50',51' of the support platform 14, as schematically represented in FIG. 8. More specifically, the supported object 12 may be disposed in the operative position for connection to the support platform 14, such as represented in FIGS. 1, 6 and 7. When the supported object 12 and the support platform 14 are so disposed, the two base members 31' may concurrently pass or be threaded through the alternating, linearly aligned loops 18', 16', 19', 17' and 20' of both the columns 50 and 51 of the support platform 14 and both columns 50' and 51' of the supported object 12. Further, the threading and removal of the base members 31' will be the same as described above with reference to the threading and removal of the single base member 31, as represented in FIG. 5.

In addition, the connector 10' preferably includes at least one locking assembly 32 connected to both the base members 31', such as at one end thereof. Moreover, the locking assembly 32 connected to and considered a part of the connector 10' will include the same structural and operative features as the locking assembly 32 represented and described in the embodiments of FIGS. 1-8.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A connector structured to removably attach a supported object to a support platform, said connector comprising:

a base formed of a substantially rigid material and having at least one base member having an elongated configuration, a locking assembly disposed on said base and including a retainer and a gripping member, said gripping member movably mounted on said retainer and movable relative to said base into a locking orientation and a release orientation, said locking orientation comprising a predetermined portion of said gripping member disposed in gripping engagement with a correspondingly disposed part of either the supported object or the support platform, wherein said gripping member and said retainer include cooperative structuring disposed to alternately position and maintain said gripping member into either said locking orientation or said release orientation, and wherein said cooperative structuring comprises correspondingly disposed parts of said gripping member and said retainer defining a frictional, snap-action engagement with one another.

2. A connector as recited in claim 1 wherein said retainer is positioned in outwardly spaced relation to said base and disposable in overlying relation to the correspondingly disposed part of either the supported object or the support platform engaged by said gripping member.

3. A connector as recited in claim 2 wherein said outwardly spaced relation comprises a substantially parallel orientation of said retainer relative to said base.

4. A connector as recited in claim 1 wherein said gripping orientation further comprises said predetermined portion of said gripping member disposed in said gripping engagement with an exterior surface of the correspondingly disposed part of either the supported object or the support platform.

5. A connector as recited in claim 4 wherein said predetermined portion of said gripping member comprises at least one projection extending outwardly from a remainder of said gripping member.

6. A connector as recited in claim 5 wherein said gripping orientation further comprises said one projection disposed in at least partially penetrating engagement with the exterior surface of the correspondingly disposed part of either the supported object or the support platform.

7. A connector as recited in claim 1 wherein said gripping member is pivotally connected to said retainer and movable relative thereto and said base between said gripping and said release orientations.

8. A connector as recited in claim 7 wherein said locking assembly further comprises an activating member disposed and structured to position said gripping member between said gripping and release orientations.

9. A connector as recited in claim 8 wherein said activating member is connected to said gripping member in outwardly extending relation to said base and a remainder of said locking assembly.

10. A connector as recited in claim 8 wherein said activating member comprises one end of said gripping member and is movable therewith relative to said base between said gripping and release orientations.

11. A connector as recited in claim 1 further comprising an activating member fixedly connected to said gripping member, said activating member movable with said gripping member relative to said base between said gripping and release orientation.

12. A connector as recited in claim 11 further comprising a pull structure connected to said activating member and disposed and structured to exert a positioning force on said gripping member via said activating member.

13. A connector structured to removably attach a supported object to a support platform, said connector comprising:

a base including a plurality of base members each having an elongated configuration and being formed of a substantially rigid material, a locking assembly disposed at one common end of said base members, said locking assembly including a retainer and a gripping member, said gripping member movably mounted on said retainer and disposable relative to said base into a locking orientation and a release orientation, said locking orientation comprising a predetermined portion of said gripping member disposed in gripping engagement with an outer surface of a correspondingly disposed part of either the supported object or the support platform, said gripping member and said retainer including cooperative structuring disposed to alternately position and maintain said gripping member into either said locking orientation or said release orientation, an activating member connected to said gripping member and movable therewith relative to said base between said gripping orientation and said release orientation, and wherein said cooperative structuring comprises correspondingly disposed parts of said gripping member and said retainer defining a movable, frictional snap-action engagement with one another.

14. A connector as recited in claim 13 wherein said retainer is disposed in outwardly spaced relation to said base members, said retainer disposable in overlying relation to the correspondingly disposed part of either the supported object or the support platform engaged by said gripping member.

15. A connector as recited in claim 14 wherein said outwardly spaced relation comprises a substantially parallel orientation of said retainer relative to said base members.

16. A connector as recited in claim 13 wherein said predetermined portion of said gripping member comprises at least one projection extending outwardly from a remainder of said gripping member; said one projection disposed in at least partially penetrating engagement with an exterior surface of the correspondingly disposed part of either the supported object or the support platform when said gripping member is in said gripping orientation.

17. A connector as recited in claim 13 wherein said gripping member is pivotally connected to said retainer and movable relative thereto and said base members between said gripping and release orientations.

18. A connector as recited in claim 13 wherein said activating member comprises one end of said gripping member and is movable therewith relative to said base members between said gripping and release orientations.

19. A connector as recited in claim 13 wherein at least two of said plurality griping members are disposed in adjacent, spaced, substantially coplanar relation to one another along at least a majority of their lengths.

* * * * *